US008689374B2

(12) United States Patent
Rudd

(10) Patent No.: US 8,689,374 B2
(45) Date of Patent: Apr. 8, 2014

(54) BED CLIP SYSTEM

(76) Inventor: Steven Rudd, West Jordan, UT (US)

( * ) Notice: Subject to any disclaimer, the term of this patent is extended or adjusted under 35 U.S.C. 154(b) by 0 days.

(21) Appl. No.: 13/357,561

(22) Filed: Jan. 24, 2012

(65) Prior Publication Data

US 2013/0185869 A1 Jul. 25, 2013

(51) Int. Cl.
*A47C 21/02* (2006.01)

(52) U.S. Cl.
USPC ..... 5/498; 5/504.1; 24/72.5; 24/265 EC

(58) Field of Classification Search
USPC ..... 5/498, 504.1; 24/72.5, 265 EC, 464, 24/465, 470, 487
See application file for complete search history.

(56) References Cited

U.S. PATENT DOCUMENTS

| | | | | |
|---|---|---|---|---|
| 806,521 | A * | 12/1905 | Childs | 24/457 |
| 2,888,730 | A * | 6/1959 | Nash | 24/465 |
| 3,092,848 | A | 6/1963 | Gronvold | |
| 3,557,410 | A * | 1/1971 | Van Buren, Jr. | 24/474 |
| 4,660,240 | A * | 4/1987 | Hutton et al. | 5/669 |
| 4,891,856 | A | 1/1990 | Thornhill | |
| 5,179,743 | A * | 1/1993 | Lanman | 5/498 |
| 5,218,729 | A | 6/1993 | Walton | |
| 6,108,837 | A * | 8/2000 | Knebel, III | 5/504.1 |
| 6,199,247 | B1 * | 3/2001 | Tsai | 24/343 |
| 6,457,194 | B1 | 10/2002 | Bennett | |
| 6,836,913 | B2 * | 1/2005 | Perrin et al. | 5/498 |
| 6,907,628 | B2 | 6/2005 | El Guermaal | |
| 7,467,428 | B2 | 12/2008 | Hanes | |
| 2004/0060113 | A1 | 4/2004 | Lantagne | |
| 2008/0289104 | A1 | 11/2008 | Rowson et al. | |

* cited by examiner

*Primary Examiner* — Michael Trettel

(57) ABSTRACT

In one embodiment of the invention, a bed clip system includes a female clip having an inlet, a male clip having a plug that is configured to be removably coupled to the inlet, and a strap coupled to at least one of the female clip and male clip.

19 Claims, 11 Drawing Sheets

BED CLIP SYSTEM

TECHNICAL FIELD

Embodiments of the invention relate generally to bed clip systems.

BACKGROUND

The task of placing a clean sheet on a bed is a time-consuming effort for many individuals. Typically, it is difficult to prevent the twisting, turning, and/or other movement of a bed sheet(s) when an individual is occupying a bed. When a bed sheet is displaced in an undesired position, the individual has to spend additional time and effort to place the sheet back into the originally desired position. Some individuals also suffer from interruptions in their sleep and/or from restless nights if their bed sheets are subject to displacements and/or if they are required to place the displaced sheets in their originally desired positions.

Previous systems or devices permit a bed sheet to be secured in place even if the occupant moves on the bed. For example, the following patent-related references disclose various approaches for securing a bed sheet on a bed: U.S. Pat. No. 3,092,848; U.S. Pat. No. 4,891,856; U.S. Pat. No. 5,218,729; U.S. Pat. No. 6,457,194; U.S. Pat. No. 6,907,628; U.S. Pat. No. 7,467,428; U.S. Publication 2004/0060113; and U.S. Publication 2008/0289104. While these systems or devices are suitable for their intended purposes, these systems or devices may require many parts and/or many components, may be mechanically complicated, may be difficult to use or assemble, may be relatively larger in size, may require customized or/and expensive manufacturing parts and/or methods, may be subject to wear-and-tear or breakdowns due to structural complexities, and/or may be expensive for a consumer.

Based on the above discussion, the current technology is limited in its capabilities and suffers from at least the above constraints and deficiencies.

SUMMARY

In one embodiment of the invention, a bed clip system includes a female clip having an inlet, a male clip having a plug that is configured to be removably coupled to the inlet, and a strap coupled to at least one of the female clip and male clip.

In another embodiment of the invention, a bed clip system includes a first clipping means having an inlet, a second clipping means having a plug that is configured to be removably coupled to the inlet, and a strap coupled to at least one of the first clipping means and the second clipping means.

In yet another embodiment of the invention, a method of assembling a bed clip system includes providing a male clip and a female clip, forming an opening in the female clip and forming a plug on the male clip, and attaching a strap to at least one of the female clip and the male clip.

It is to be understood that both the foregoing general description and the following detailed description are exemplary and explanatory only and are not restrictive of the invention, as claimed.

The accompanying drawings, which are incorporated in and constitute a part of this specification, illustrate one (several) embodiment(s) of the invention and together with the description, serve to explain the principles of the invention.

BRIEF DESCRIPTION OF THE DRAWINGS

Non-limiting and non-exhaustive embodiments of the invention are described with reference to the following figures, wherein like reference numerals refer to like parts throughout the various views unless otherwise specified.

Additionally, the left-most digit of a reference number may identify the drawing in which the reference number first appears unless otherwise indicated.

DETAILED DESCRIPTION OF PREFERRED EMBODIMENTS

Figure 1:
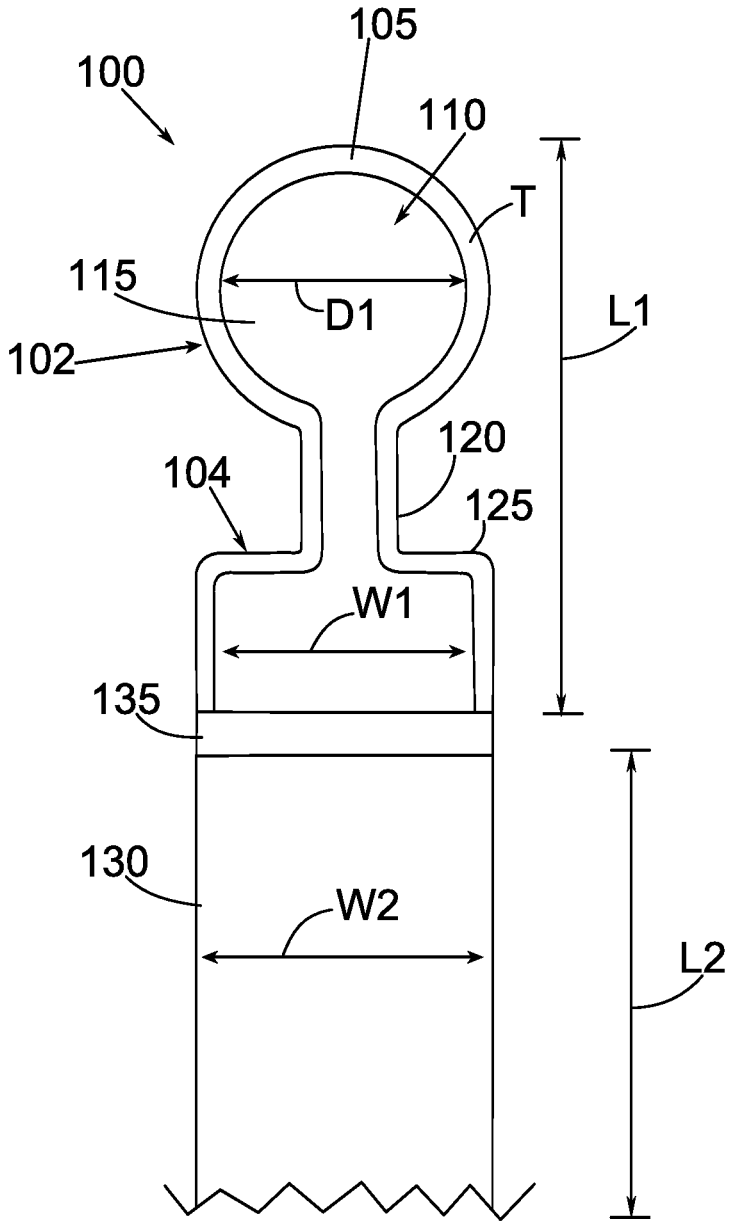
FIG. 1 is a block diagram of a female clip in a bed clip system, in accordance with an embodiment of the invention.

In the description herein, numerous specific details are provided, such as examples of components, parts, structures, and/or methods, to provide a thorough understanding of embodiments of the invention. One skilled in the relevant art will recognize, however, that an embodiment of the invention can be practiced without one or more of the specific details, or with other apparatus, systems, methods, components, materials, parts, structures, and/or the like. In other instances, well-known structures, materials, or operations are not shown or described in detail to avoid obscuring aspects of embodiments of the invention. Additionally, the figures are representative in nature and their shapes are not intended to illustrate the precise shape or precise size of any element and are not intended to limit the scope of the invention.

Those skilled in the art will understand that when an element or part in the drawings is referred to as being "on" (or "connected" to or "coupled" to or "attached" to) another element, it can be directly on (or attached to) the other element or intervening elements may also be present. Furthermore, relative terms such as "inner", "outer", "upper", "above", "lower", "beneath", and "below", "upward", "downward", "clockwise", "counter-clockwise", and similar terms, may be used herein to describe a relationship of one element to another element. It is understood that these terms are intended to encompass different orientations of the device in addition to the orientation depicted in the figures.

Although the terms first, second, and the like may be used herein to describe various elements, components, parts, regions, layers, chambers, and/or sections, these elements, components, parts, regions, layers, chambers, and/or sections should not be limited by these terms. These terms are only used to distinguish one element, component, part, region, layer, chamber, or section from another element, component, part, region, layer, chamber, or section. Thus, a first element, component, part, region, layer, chamber, or section discussed below could be termed a second element, component, part, region, layer, chamber, or section without departing from the teachings of the present invention.

Embodiments of the invention may be described herein with reference to cross-sectional view illustrations that are schematic illustrations of representative embodiments of the invention. As such, variations from the shapes of the illustrations as a result of, for example, manufacturing techniques and/or tolerances are expected. For purposes of avoiding in overcrowding the drawings, the elements shown in the drawings are not necessarily drawn to scale, and the elements may be larger in physical size or smaller in physical size than as shown in the drawings.

Embodiments of the invention should not be construed as limited to the particular shapes of the regions or components/parts/elements illustrated herein but are to include deviations in shapes that result, for example, from manufacturing or particular implementations. For example, an element illustrated or described as square or rectangular may typically have rounded or curved features due to normal manufacturing tolerances or due to a particular implementation. Thus, the elements illustrated in the figures are schematic in nature and their shapes are not intended to illustrate the precise shape of an element of a device and are not intended to limit the scope of the invention.

FIG. 1 is a block diagram of a female clip 100 in a bed clip system, in accordance with an embodiment of the invention. The female clip 100 is seen from a top view in FIG. 1. In the discussion herein, the terms that refer to a direction (e.g., top, bottom, front, back, upper, lower, left, right, above, beneath, and other directional terms) are used to denote a direction or position in reference to an embodiment of a bed clip system when viewed from the perspective of a user who is viewing the bed clip system. The exemplary shapes of the female clip 100 (and other components) as shown in the drawings are not limiting in various embodiments of the invention. It is also noted that the components shown in the drawings are not necessarily drawn to scale, and some components may be shown in an exaggerated size for purposes of focusing on features in various embodiments of the invention.

In an embodiment of the invention, the female clip 100 includes a first area 102 and a second area 104. The first area 102 and second area 104 are typically integrated as a single piece. However, the areas 102 and 104 may also be two individual pieces that are then attached together by suitable methods such as, for example, welding, use of glue, screw attachments, or other methods or mechanisms.

In one embodiment, the first area 102 is circular in shape and includes a rim portion 105 that surrounds an opening 110 that is above a bottom surface 115. However, the first area 102 can have another suitable shape in other embodiments of the invention. The rim portion 105 is a wall extending away from and surrounding the bottom surface 115.

In one embodiment, the second area 104 includes a narrow portion 120 that is adjacent to and coupled to the first area 102 and a wide portion 125 that is adjacent to and coupled to the narrow portion 120. The rim portion 105 can extend to and be a part of the narrow portion 120 and wide portion 125. In another embodiment, the second area 104 can have a shape that differs from the shapes shown in FIG. 1.

In an embodiment of the invention, the female clip 100 can be formed by a material such as, by way of example and not by way of limitation, metal. However, the female clip 100 may also be formed by other suitable materials such as, by way of example and not by way of limitation, steel, rigid rubber, rigid alloy, durable plastic, other durable synthetic materials, any suitable durable material, or another suitable type of material.

The dimension of the female clip 100 may be set at any suitable size. By way of example and not by way of limitation, the rim portion 105 has a thickness T of approximately ⅛ inch, the female clip 100 has a length L1 of approximately 2¼ inches and a width W1 of approximately 1.0 inch, and a first area diameter D1 of approximately 1.0 inch. The first area diameter D1 is the maximum opening measurement within the rim portion 105. The values of T, L1, W1, and D1 may be set to other suitable values.

In an embodiment of the invention, a strap material 130 (i.e., strap 130) is coupled to the female clip 100 by a suitable connector 135. By way of example and not by way of limitation, the connector 135 is an adhesive 135 that connects the strap material 130 to the female clip 100. In another example, the connector 135 is attached to the female clip 100 (e.g., by glue or by use of another method or mechanism), and the strap material 130 is stitched (or attached by use of another method or mechanism) to the connector 135. While the strap 130 is typically elastic or stretchable, other embodiments of the invention may include a strap 130 that is not necessarily elastic or stretchable and that may be more rigid.

By way of example and not by way of limitation, the strap material 130 has a width W2 of 1 inch. The value of W2 may be set to other suitable values. The strap material 130 is also typically stretchable in one embodiment and has a length L2 that varies in length based on (or has a length L2 based on) the mattress sizes of twin, full, queen, king, or children. For example, a female clip 100 that is used for a twin sized mattress will have a strap material 130 with a length L2 that is shorter than the length L2 of a strap material 130 for a female clip 100 that is used for a full sized mattress, queen sized mattress, or king sized mattress.

Figure 2:
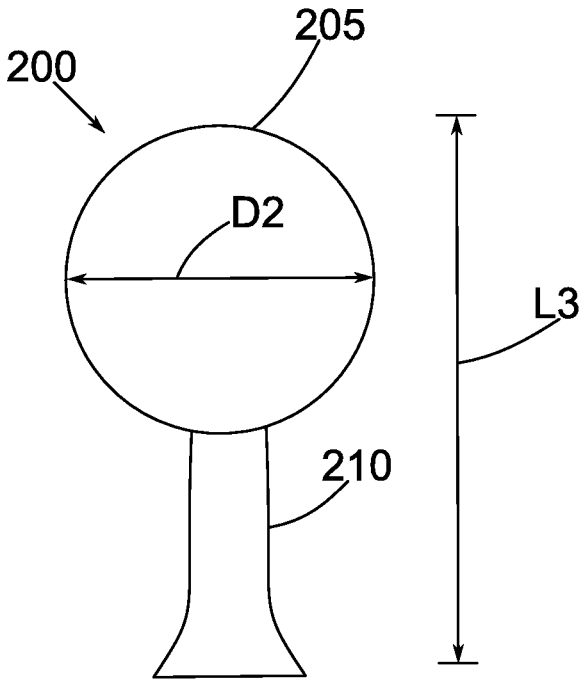
FIG. 2 is a block diagram of a male clip in a bed clip system, in accordance with an embodiment of the invention.

FIG. 2 is a block diagram of a male clip 200 in a bed clip system, in accordance with an embodiment of the invention. The male clip 200 is seen from a top view in FIG. 2. The exemplary shapes of the male clip 200 as shown in the drawings are not limiting in various embodiments of the invention.

In an embodiment of the invention, the male clip 200 includes a circular portion 205 and an extension 210 that is coupled to the circular portion 205. The circular portion 205 is received by the opening 110 (inlet 110) of the female clip 100 as discussed in FIG. 3 below. Therefore, the male clip 200 will be removably coupled to the female clip 100. Two components are removably coupled (or removably attached or removably inserted) means that two different components can be attached together or detached apart. Since the male clip 20 may vary in shape, the portion 205 is not necessarily circular in shape in another embodiment of the invention.

In an embodiment of the invention, the male clip 200 can be formed by a material such as, by way of example and not by way of limitation, rubber. However, the male clip 200 may also be formed by other suitable materials that permit the circular portion 205 to be removably coupled to the female clip 100 in a secure manner or tight manner. Additionally, while the circular portion 205 and extension 210 are typically formed by rubber, the portion 205 and/or extension 210 may be formed by other suitable materials. For example, the portion 205 and/or extension 210 may be formed by another type of flexible material such as, by way of example and not by way of limitation, a flexible material. As a further example, the extension 210 may be formed of a flexible material such as, e.g., plastic, bendable metal, or bendable alloy.

The dimension of the male clip 200 may be set at any suitable size. By way of example and not by way of limitation, the circular portion 205 has a circular portion diameter D2 of approximately 1.0 inch and the male clip 200 has a length L3 of approximately 2¼ inches. The values of D2 and L3 may be set to other suitable values.

Figure 3:
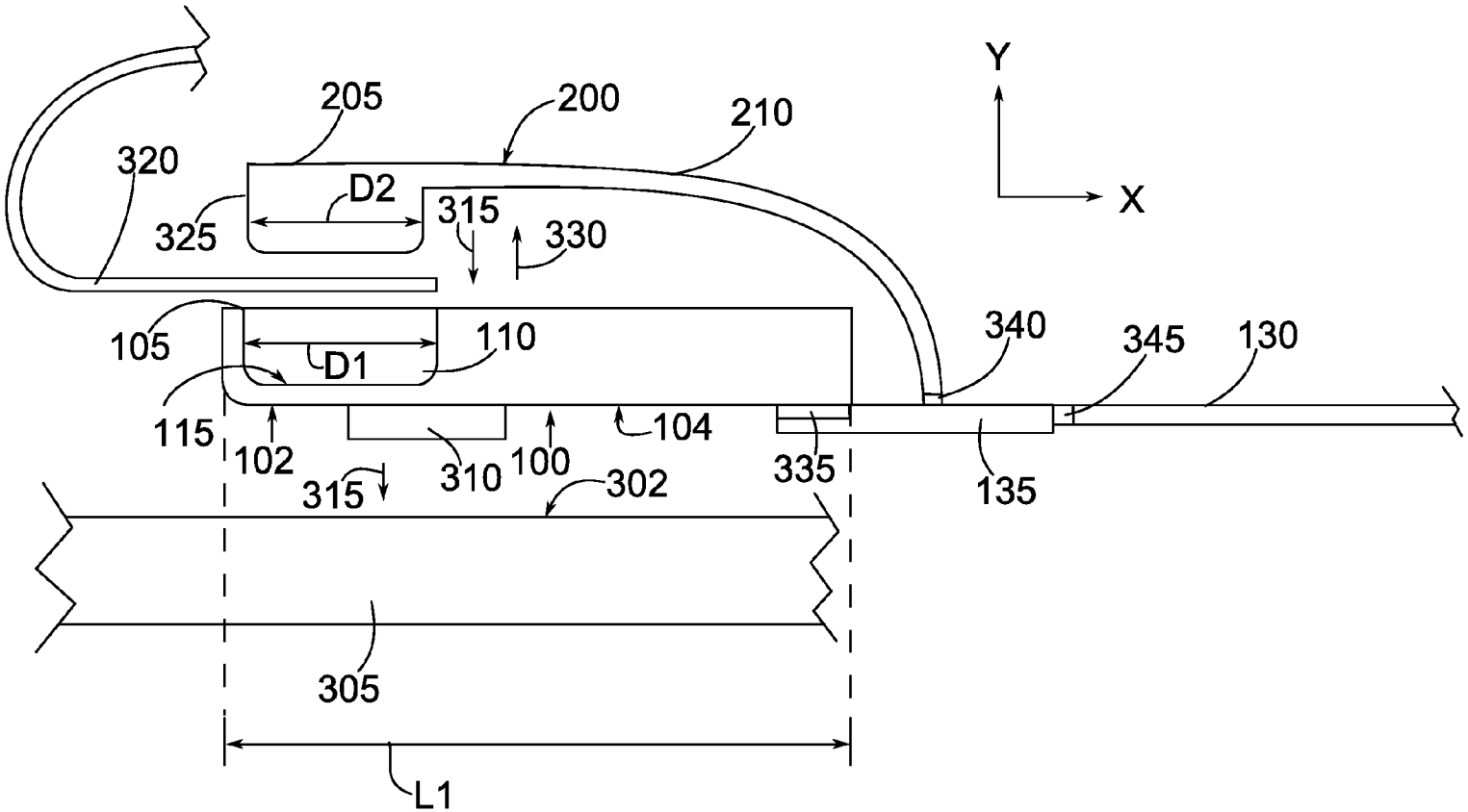
FIG. 3 is a block diagram of a female clip and male clip in a bed clip system, in accordance with an embodiment of the invention.

FIG. 3 is a block diagram of a female clip 100 and male clip 200 in a bed clip system, in accordance with an embodiment of the invention. The female clip 100 and male clip 200 are seen from a side view in FIG. 3.

The female clip 100 can be configured to be attached to (and/or can be configured to be removably coupled to) a top surface 302 of a mattress 305. For example, a connector 310 is used to attach the female clip 100 to the surface 302. By way of example and not by way of limitation, the connector 310 is an adhesive layer 310. The female clip 100 is moved in the downward direction 315 (along the Y-axis) in order to attach the female clip 100 to the surface 302.

A bed sheet 320 is inserted on top of the female clip 100. Specifically, the bed sheet 320 is disposed on the rim portion 105. The male clip 200 is then moved in the downward direction 315 so that the plug 325 of the circular portion 205 is inserted into the opening 115 (i.e., inlet 115) of the female clip 100. A portion of the bed sheet 320 will be between the opening 115 and the plug 325 when the plug 325 is inserted in the opening 115 and the male clip 200 is removably coupled to the female clip 100. The extension 210 is sufficiently flexible and bendable so that the user can removably insert the plug 325 into the opening 110 in the downward direction 315 (along the Y-axis) and can detach the plug 325 from the opening 110 by moving the plug 325 in the upward direction 330 along the Y-axis. The plug 325 will have a maximum diameter of D2 which is, for example, approximately 1.0 inch. The plug 325 will typically be substantially circular in shape in one embodiment of the invention.

In an embodiment of the invention, the female clip 100 is coupled by a connector piece 335 to the connector 135. The connector piece 335 may be, for example, an adhesive piece 335 that securely attaches the female clip 100 to the connector 135. By way of example and not by way of limitation, the second area 104 of the female clip 100 is attached to the connector 135 via the connector piece 335.

In an embodiment of the invention, the male clip 200 is coupled by a connector piece 340 to the connector 135. The connector piece 340 may be, for example, an adhesive piece 340 that securely attaches the male clip 200 to the connector 135. By way of example and not by way of limitation, the extension 210 of the male clip 200 is attached to the connector 135 via the connector piece 340. Therefore, the male clip 200 is coupled by the connector 135 to the female clip 100.

In an embodiment of the invention, the strap material 130 is coupled by a connector piece 345 to the connector 135. The connector piece 345 may be, for example, an adhesive piece 345 (or stitching 345 or another suitable attachment mechanism) that securely attaches the strap material 130 to the connector 135.

Figure 4:
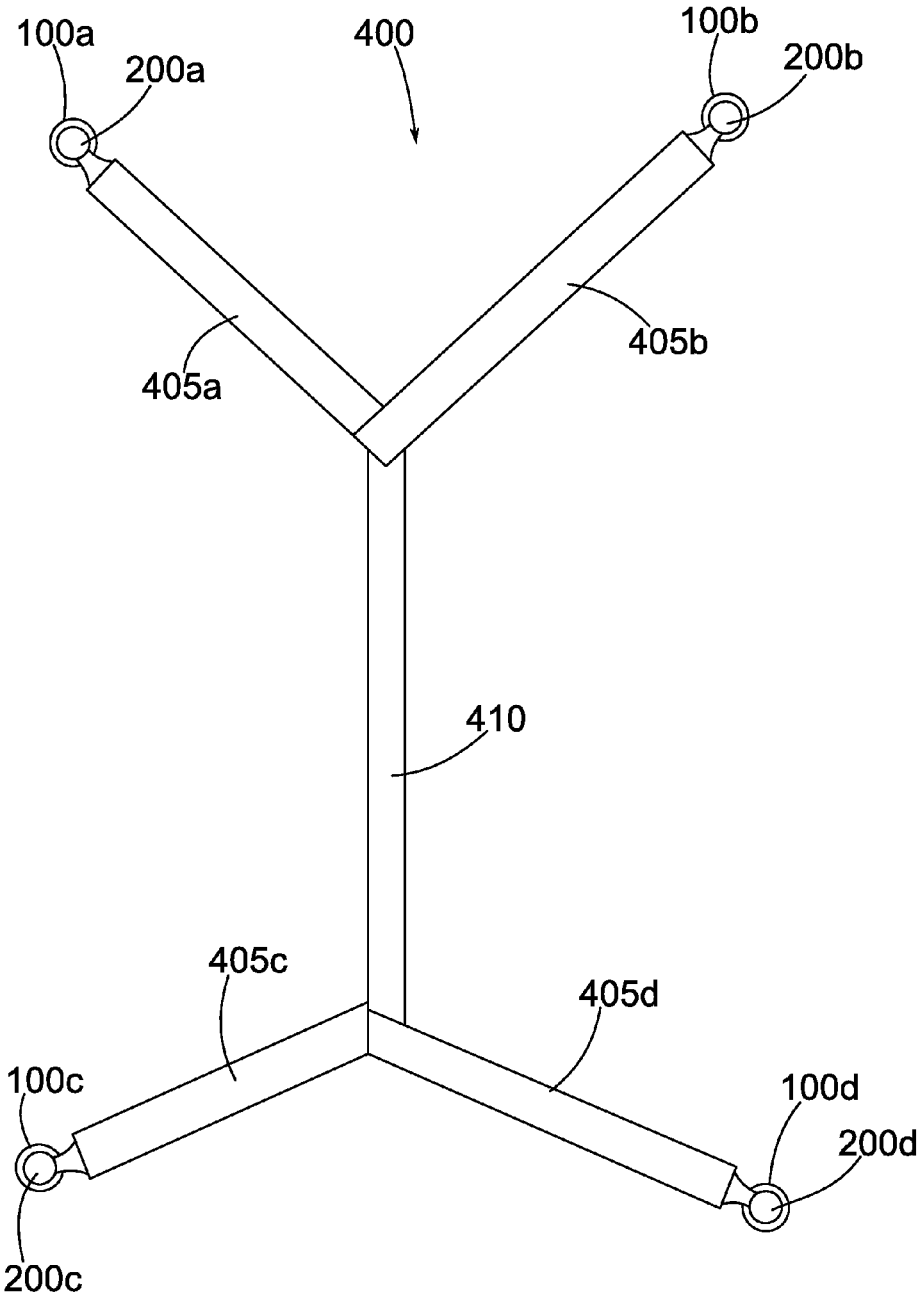
FIG. 4 is a block diagram of a bed clip system, in accordance with an embodiment of the invention.

FIG. 4 is a block diagram of a bed clip system 400, in accordance with an embodiment of the invention. The bed clip system 400 includes the female clips 100*a*, 100*b*, 100*c*, and 100*d*, male clips 200*a*, 200*b*, 200*c*, and 200*d*, straps 405*a*, 405*b*, 405*c*, and 405*d*, and center strap 410. Each of the female clips 100*a*-100*d* includes the features of the female clip 100. Each of the male clips 200*a*-200*d* includes the features of the male clip 200. The female clips 100*a*-100*d* are configured to be coupled to the mattress surface 302 as similarly discussed above. Typically, each of the female clips 100*a*-100*d* is disposed adjacent to (or is near) a respective corner of a mattress 305. The female clips 100*a*, 100*b*, 100*c*, and 100*d* are coupled to the straps 405*a*, 405*b*, 405*c*, and 405*d*, respectively. The male clips 200*a*, 200*b*, 200*c*, and 200*d* are also coupled to the straps 405*a*, 405*b*, 405*c*, and 405*d*, respectively, via a connector 135 as similarly discussed in FIG. 1. The male clips 200*a*, 200*b*, 200*c*, and 200*d* are removably coupled to the female clips 100*a*, 100*b*, 100*c*, and 100*d*, respectively. The female clips 100*a*-100*d* and male clips 200*a*-200*d* are configured to secure a bed sheet 320 in place as similarly discussed in FIG. 3. Therefore, the bed sheet 320 is secured adjacent to (or near) each corner of a mattress 305 by a respective pair of a male clip 200 and female clip 100.

In an embodiment of the invention, the straps 405*a*-405*d* are typically elastic or stretchable. However, the straps 405*a*-405*d* can also be formed from a rigid material in another embodiment of the invention. The straps 405*a*-405*d* can vary in size for each particular bed clip system 400, so that a bed clip system 400 is available for securing a bed sheet on a mattress of any size (e.g., twin, full, queen, king, or children sizes).

In an embodiment of the invention, the center strap 410 is coupled to each of the straps 405*a*-405*d* as shown in FIG. 4. The center strap 410 is typically a non-elastic material such as, by way of example and not by way of limitation, a non-elastic nylon. However, other embodiments of the invention may include a center strap 410 that is elastic and/or stretchable.

Figure 5:
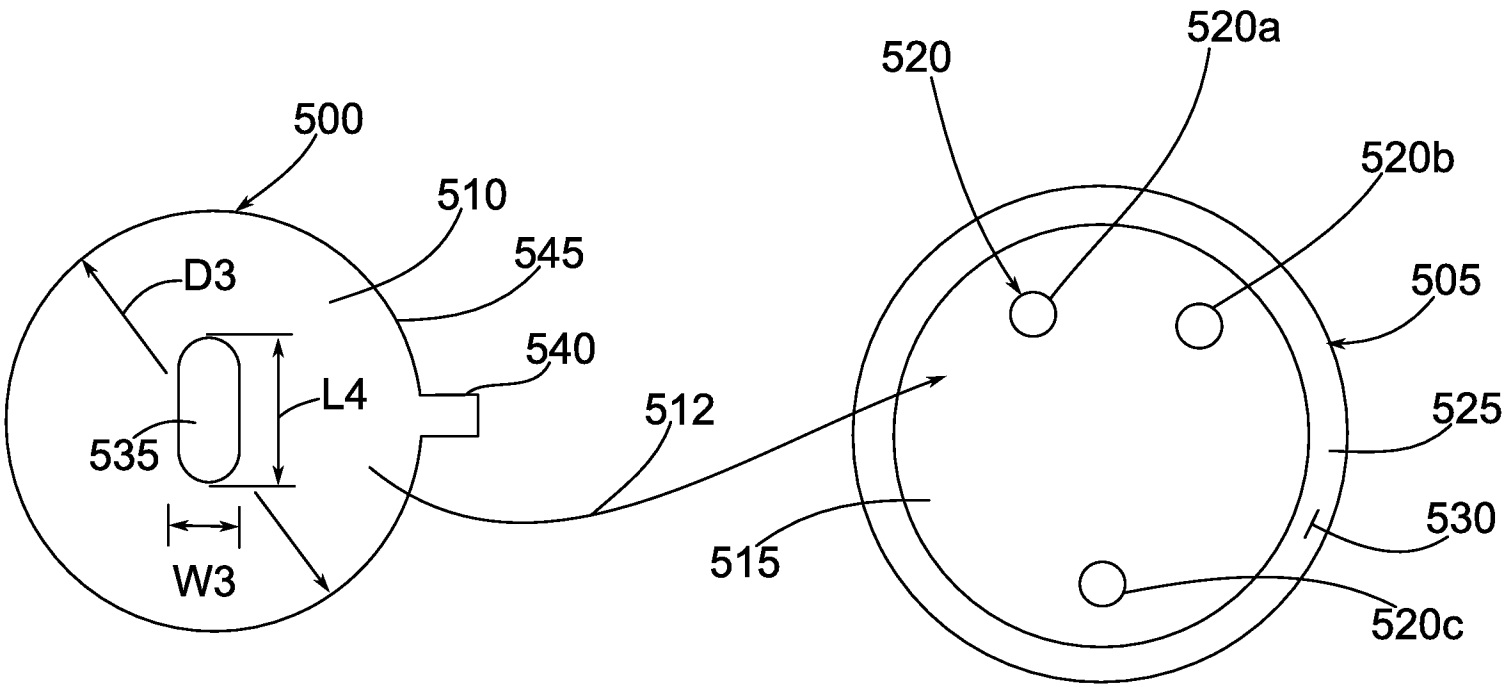
FIG. 5 is a block diagram of a female clip and backing plate in a bed clip system, in accordance with another embodiment of the invention.

FIG. 5 is a block diagram of a female clip 500 and backing plate 505 in a bed clip system, in accordance with another embodiment of the invention. The female clip 500 is seen from a bottom view and the backing plate 505 is seen from a top view in FIG. 5. The bottom surface 510 of the female clip 500 is disposed (512) on or above the top surface 515 of the backing plate 505. In one embodiment, the female clip 500 is coupled to the backing plate 505 by a plurality of connectors 520 (or by at least one connector 520). By way of example and not by way of limitation, the connectors 520 are rivets (which are permanent mechanical fasteners) or are other suitable fasteners. However, the connectors 520 can be another type of suitable mechanism for coupling the female clip 500 to the backing plate 505. The number of connectors 520 can also vary. For example, the number of connectors 520 may vary from one connector 520 to multiple connectors 520. The exemplary backing plate 505 includes at least one connector 520 such as, for example, the connectors 520*a*, 520*b*, and 520*c*.

In an embodiment of the invention, the backing plate 505 includes an outer portion 525 that is coupled to a fitted bed sheet or another suitable type of bed sheet. In one embodiment, the outer portion 525 is coupled to the fitted bed sheet 600 by the backing plate connector component 530 which may be, for example, a stitching or adhesive connection.

In an embodiment of the invention, the female clip 500 includes an inlet 535 (i.e., opening 535) that is configured to receive and removably secure a plug of a male clip. The shape of inlet 535 may vary. Although FIG. 5 shows the inlet 535 as non-circular in shape, in another embodiment of the invention, the inlet 535 is substantially circular in shape.

In an embodiment of the invention, the female clip 500 may include a raised notch 540 on the perimeter 545 of the female clip 500. Although FIG. 5 shows the raised notch 540 as substantially rectangular or square in shape, in another embodiment of the invention, the raised notch 540 may have other suitable shapes such as, for example, a half-circular shape or another curved shape. The raised notch 540 is configured to removably secure and removably lock a male clip 700 into place with the female clip 500, as will be discussed below.

The dimension of the female clip 500 may be set at any suitable size. By way of example and not by way of limitation, the female clip 500 has a diameter D3 of approximately 2.0 inches, and the inlet 535 has a length L4 (or diameter L4) of approximately ¾ inch and a width W3 of approximately ¼ inch. The values of D3, L4, and W3 may be set to other suitable values.

In an embodiment of the invention, the female clip 500 can be formed by a material such as, by way of example and not by way of limitation, a molded plastic material. However, the female clip 500 may also be formed by other suitable materials such as, by way of example and not by way of limitation, metal, steel, rigid rubber, rigid alloy, other durable synthetic materials, any suitable durable material, or another suitable type of material. The backing plate 505 can also be formed by a material such as, by way of example and not by way of limitation, a molded plastic material, metal, steel, rigid rubber, rigid alloy, other durable synthetic materials, any suitable durable material, or another suitable type of material.

Figure 6A:
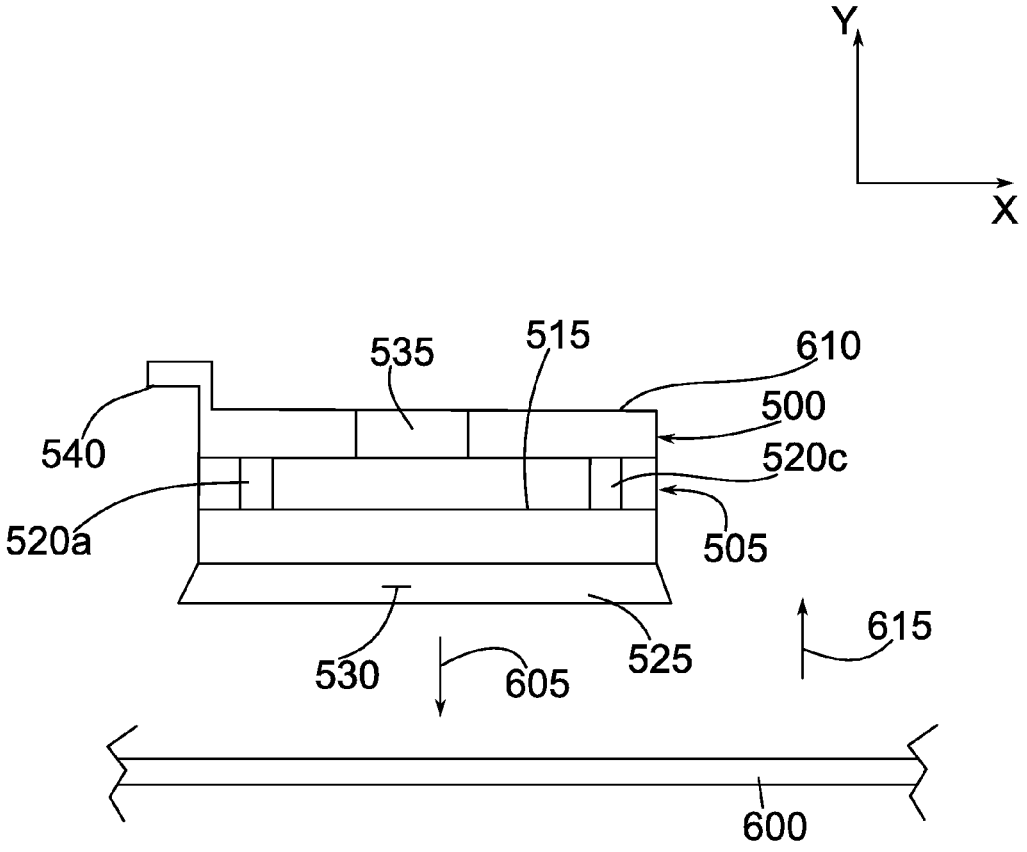
FIG. 6A is a block diagram of a female clip and backing plate in a bed clip system, in accordance with another embodiment of the invention.
Figure 6B:
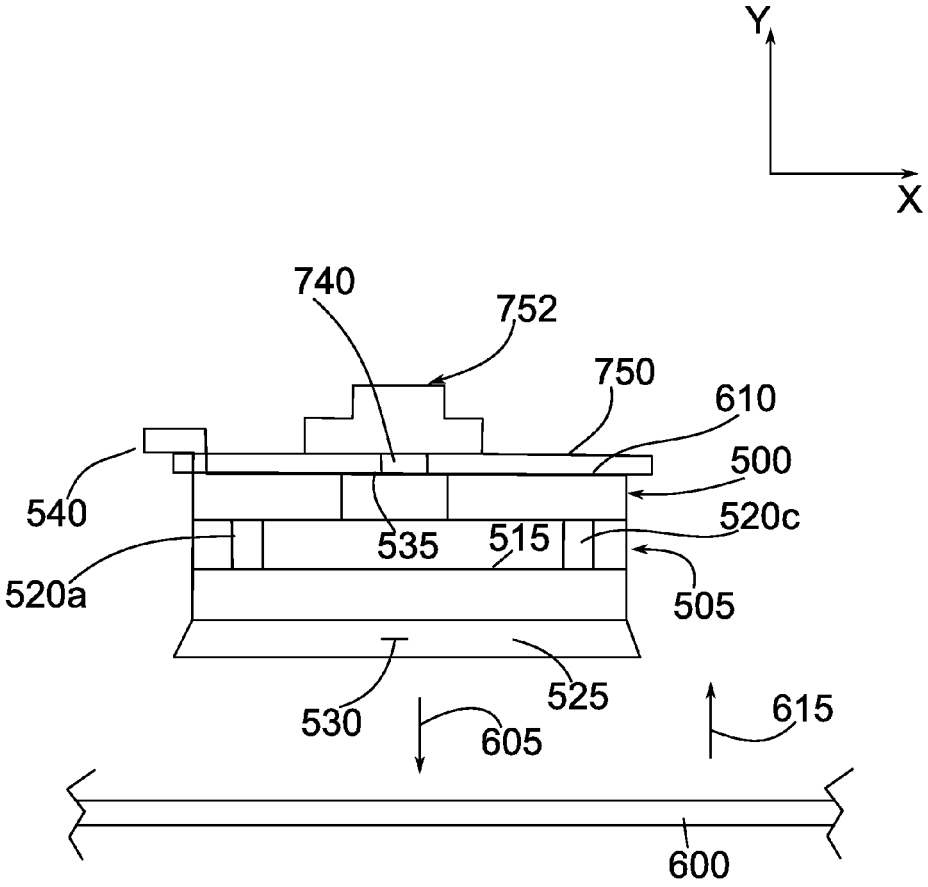
FIG. 6B is a block diagram of a male clip removably coupled to a female clip in a bed clip system, in accordance with another embodiment of the invention.

FIG. 6A is a block diagram of a female clip 500 and backing plate 505 in a bed clip system, in accordance with another embodiment of the invention. It is also noted that FIG. 6B is a block diagram of a male clip 700 coupled to the female clip 500 in accordance with an embodiment of the invention, as will be discussed further below. The female clip 500 and backing plate 505 are shown as coupled together in FIG. 6. The connectors 520*a*-520*c* are configured to connect the female clip 500 to the backing plate 505. The outer portion 525 of the backing plate 505 can be coupled (605) to a fitted bed sheet 600 by use of a suitable connector mechanism 530 such as, for example, a stitching or adhesive.

Figure 7:
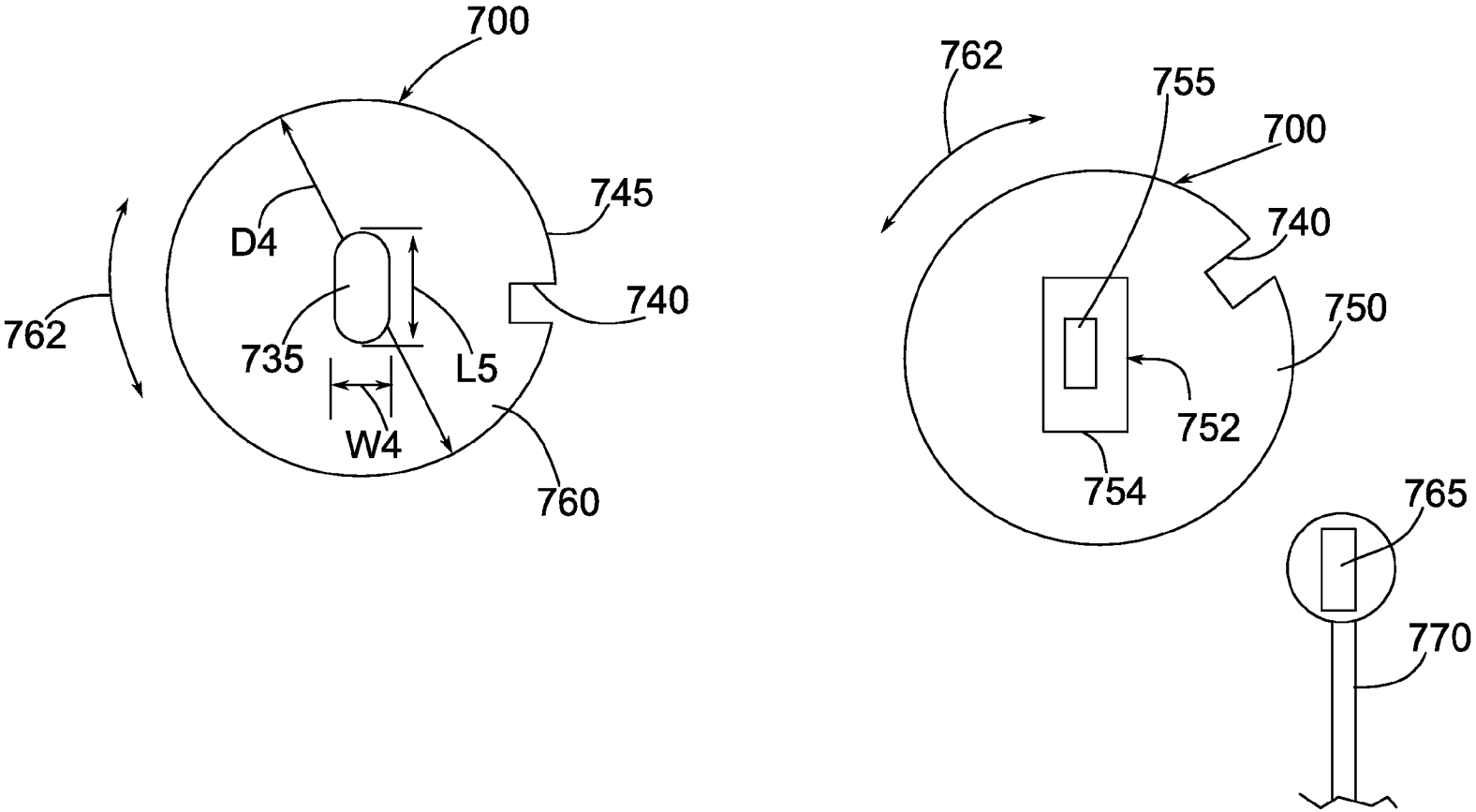
FIG. 7 is a block diagram of a male clip in a bed clip system, as shown in a bottom view and top view, in accordance with another embodiment of the invention.

FIG. 7 is a block diagram of a male clip 700 in a bed clip system, as shown in a bottom view and top view, in accordance with another embodiment of the invention.

In an embodiment of the invention, the male clip 700 includes an outlet 735 (i.e., plug 735) that is configured to be inserted into and removably secured to the inlet 535 of the female clip 500. Although FIG. 7 shows the plug 735 as non-circular, in another embodiment of the invention, the plug 735 is substantially circular in shape. In an embodiment of the invention, the male clip 700 may include an inlet notch 740 on the perimeter 745 of the male clip 700. Although FIG. 7 shows the inlet notch 740 as substantially rectangular or square in shape, in another embodiment of the invention, the inlet notch 740 may have other suitable shapes such as, for example, a half-circular shape or another curved shape. The inlet notch 740 is configured to be inserted around the raised notch 540 of the female plug 500, so that the male clip 700 is removably secured and removably locked into place with the female clip 500.

The dimension of the male clip 700 may be set at any suitable size. By way of example and not by way of limitation, the male clip 700 has a diameter D4 of approximately 2.0 inches, and the outlet 735 has a length L5 (or diameter L5) of approximately ¾ inch and a width W4 of approximately ¼ inch. The values of D4, L5, and W4 may be set to other suitable values.

In an embodiment of the invention, the male clip 700 can be formed by a material such as, by way of example and not by way of limitation, a molded plastic material. However, the male clip 700 may also be formed by other suitable materials such as, by way of example and not by way of limitation, metal, steel, rigid rubber, rigid alloy, other durable synthetic materials, any suitable durable material, or another suitable type of material.

The top surface 750 of the male clip 700 includes a turn handle 752 with grip section 754 and protruding end 755.

The bottom surface 760 of the male clip 700 is placed on the top surface 610 (FIG. 6B) so that the plug 735 is inserted into the inlet 535 of the female clip 500 and so that the male clip 700 is removably coupled to the female clip 500. When the bottom surface 760 is placed on the top surface 610, the inlet notch 740 of the male clip 700 is received by the raised notch 540 of the female clip 500. The top surface 750 of the male clip 700 will be below the raised notch 540 of the female clip 500 after the slot 535 receives the plug 735 and the raised notch 540 (FIG. 6B) receives the inlet notch 740. The male clip 700 is configured to be rotated 762 with respect to the Y-axis (FIG. 6B) so that the raised notch 540 (FIG. 6B) is disposed adjacent to the top surface 750, the raised notch 540 and inlet notch 740 are vertically offset from each other with respect to the Y-axis (FIG. 6B), and the raised notch 540 blocks the top surface 750 from moving upward 615 along the Y-axis. Therefore, when the raised notch 540 is blocking the top surface 750, the male clip 700 is locked in place to the female clip 500.

An eyelet 765 may also be placed around and coupled to the protruding end 755. The eyelet 765 is coupled to an attachment band 770 and may also be coupled to straps as will be discussed further below. Therefore, the turn handle 752 is configured to be coupled to the attachment band 770 (i.e., strap 770).

Figure 8:
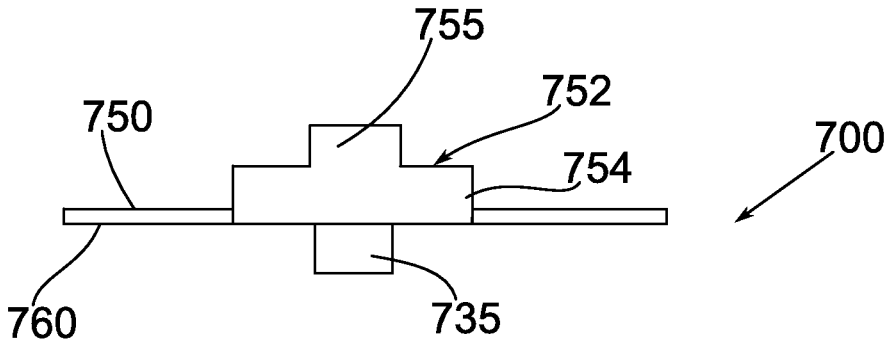
FIG. 8 is a block diagram of a male clip in a bed clip system, as shown in a side view, in accordance with another embodiment of the invention.

FIG. 8 is a block diagram of a male clip 700 in a bed clip system, as shown in a side view, in accordance with another embodiment of the invention. The top surface 750 of the male clip 700 is configured to be blocked by the raised notch 540 of the female clip 500.

Figure 9:
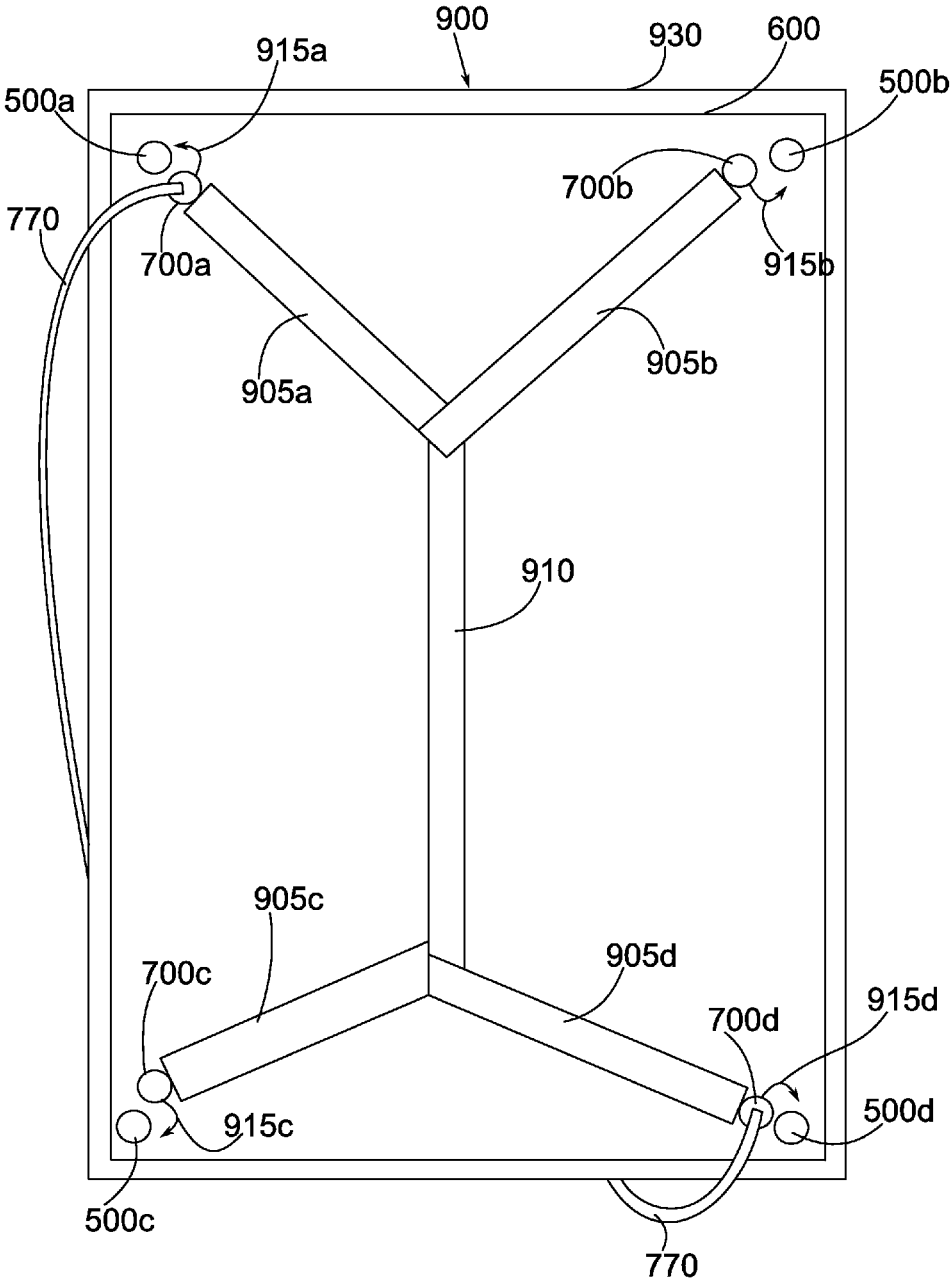
FIG. 9 is a block diagram of a bed clip system, in accordance with another embodiment of the invention.

FIG. 9 is a block diagram of a bed clip system 900, in accordance with an embodiment of the invention. The bed clip system 900 includes the female clips 500*a*, 500*b*, 500*c*, and 500*d*, male clips 700*a*, 700*b*, 700*c*, and 700*d*, straps 905*a*, 905*b*, 905*c*, and 905*d*, center strap 910, and at least one attachment band 770. Each of the female clips 500*a*-500*d* includes the features of the female clip 500. Each of the male clips 700*a*-700*d* includes the features of the male clip 700. The female clips 500*a*-500*d* are configured to be coupled to the fitted bed sheet 600 as similarly discussed above. Typically, each of the female clips 500*a*-500*d* is adjacent to or near a respective corner of the bed sheet 600. The male clips 700*a*, 700*b*, 700*c*, and 700*d* are coupled to the straps 905*a*, 905*b*, 905*c*, and 905*d*, respectively, by use of an eyelet 765 that is removably coupled to the turn handle 752 as similarly discussed above. The male clips 700*a*, 700*b*, 700*c*, and 700*d* are removably coupled 915*a*, 915*b*, 915*c*, and 915*d* to the female clips 500*a*, 500*b*, 500*c*, and 500*d*, respectively. At least one attachment band 770 is attached to two male clips 700 and is placed underneath a mattress 930 that supports the fitted bed sheet 600. In the exemplary bed clip system 900, the attachment band 770 is coupled to the male clips 700*a* and 700*d*. However, the attachment band 770 can be coupled to any two of the male clips 700*a*, 700*b*, 700*c*, and 700*d*. Additionally, the exemplary bed clip system 900 can have more than one attachment bands 770. Therefore, the bed sheet 600 is secured adjacent to each corner of a mattress 930 by a respective pair of a male plug 700 and female plug 500.

In an embodiment of the invention, the straps 905*a*-905*d* are typically elastic or stretchable. However, the straps 905*a*-905*d* can also be formed from a rigid material. The straps 905*a*-905*d* can vary in size for each particular bed clip system 900, so that a bed clip system 900 is available for securing a bed sheet on a mattress of any size (e.g., twin, full, queen, king, or children sizes).

In an embodiment of the invention, the center strap 910 is coupled to each of the straps 905*a*-905*d* as shown in FIG. 9. The center strap 910 is typically a non-elastic material such as, by way of example and not by way of limitation, a non-elastic nylon. However, other embodiments of the invention may include a center strap 910 that is elastic and/or stretchable.

Figure 10:
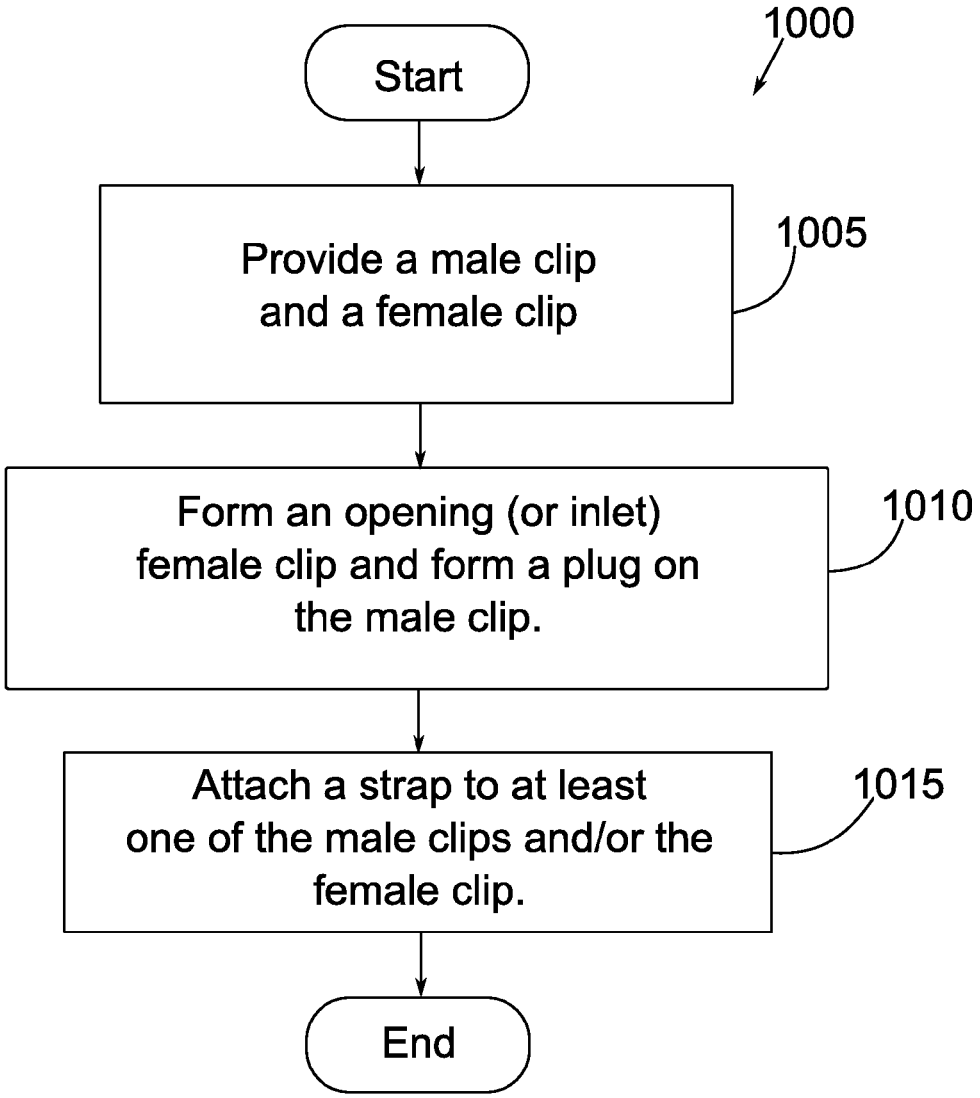
FIG. 10 is a flow diagram of a method of assembling a bed clip system, in accordance with an embodiment of the invention.

FIG. 10 is a flow diagram of a method 1000 of assembling a bed clip system, in accordance with an embodiment of the invention. In block 1005, a male clip and a female clip are provided. In block 1010, an opening (or inlet) is formed in the female clip and a plug is formed on the male clip. In block 1015, a strap is attached to at least one of the male clip and/or the female clip. In one embodiment of the invention, a strap 300 is attached to both the male clip 200 and female 100 by use of the connector 135. In another embodiment of the invention, a strap (e.g., strap 905*a*) is attached to a male clip (e.g., male clip 700*a*) by use of an eyelet 770.

In one embodiment of the invention, a bed clip system includes a female clip having an inlet, a male clip having a plug that is configured to be removably coupled to the inlet, and a strap coupled to at least one of the female clip and male clip.

In another embodiment of the invention, a bed clip system includes a first clipping means having an inlet, a second clipping means having a plug that is configured to be removably coupled to the inlet, and a strap coupled to at least one of the first clipping means and the second clipping means.

In yet another embodiment of the invention, a method of assembling a bed clip system includes providing a male clip and a female clip, forming an opening in the female clip and forming a plug on the male clip, and attaching a strap to at least one of the female clip and the male clip.

Other variations and modifications of the above-described embodiments and methods are possible in light of the teaching discussed herein.

The above description of illustrated embodiments of the invention, including what is described in the Abstract, is not intended to be exhaustive or to limit the invention to the precise forms disclosed. While specific embodiments of, and examples for, the invention are described herein for illustrative purposes, various equivalent modifications are possible within the scope of the invention, as those skilled in the relevant art will recognize.

These modifications can be made to the invention in light of the above detailed description. The terms used in the following claims should not be construed to limit the invention to the specific embodiments disclosed in the specification and the claims. Rather, the scope of the invention is to be determined entirely by the following claims, which are to be construed in accordance with established doctrines of claim interpretation.

What is claimed is:

1. A bed clip system comprising:
a female clip having an inlet;
a male clip having a plug that is configured to be removably coupled to the inlet;
a strap coupled to at least one of the female clip and male clip; and
a backing plate;
wherein the female clip is coupled to the backing plate by at least one connector.

2. The bed clip system of claim 1, wherein the strap is coupled to each of the female clip and the male clip.

3. The bed clip system of claim 1, wherein the strap is coupled to the male clip.

4. The bed clip system of claim 1, wherein the strap comprises a length that is based on a mattress size.

5. The bed clip system of claim 1, wherein the inlet and the plug are each circular in shape.

6. The bed clip system of claim 1, wherein the female clip is configured to be coupled to a mattress.

7. The bed clip system of claim 1, wherein a bed sheet is inserted between the male clip and the female clip.

8. The bed clip system of claim 1, wherein the male clip further comprises an extension and wherein the extension of the male clip is coupled by a connector to the female clip.

9. The bed clip system of claim 1, further comprising additional female clips and additional male clips, and wherein a respective one of a pair of female and male clips is disposed near a respective corner of a mattress.

10. The bed clip system of claim 1, wherein the backing plate is coupled to a bed sheet.

11. The bed clip system of claim 1, wherein the female clip comprises a raised notch and the male clip comprises an inlet notch.

12. The bed clip system of claim 11, wherein the inlet notch is configured to be inserted around the raised notch, so that the male clip is removably secured and removably locked into place with the female clip.

13. The bed clip system of claim 1, wherein the male clip comprises a turn handle.

14. The bed clip system of claim 13, wherein the turn handle is configured to be coupled to the strap.

15. The bed clip system of claim 1, wherein the male clip is configured to be rotated with respect to a Y-axis so that a raised notch of the female clip will block a top surface of the male clip.

16. The bed clip system of claim 1, further comprising additional female clips and additional male clips, and wherein a respective one of a pair of female and male clips is disposed near a respective corner of a bed sheet.

17. The bed clip system of claim 16, further comprising additional straps and a center strap coupled to the straps, and wherein a respective one of the straps is coupled to a respective one of the male clips.

18. A bed clip system comprising:
a first means for clipping, said first means having an inlet;
a second means for clipping, said second means having a plug that is configured to be removably coupled to the inlet;
a strap coupled to at least one of the first means for clipping and the second means for clipping; and
a backing plate;
wherein the first means for clipping is coupled to the backing plate by at least one connector.

19. A method of assembling a bed clip system comprising:
providing a male clip, a female clip, and a backing plate;
forming an opening in the female clip and forming a plug on the male clip; and
attaching a strap to at least one of the female clip and the male clip;
wherein the female clip is coupled to the backing plate by at least one connector.

* * * * *